US005203507A

United States Patent [19]

Matthews

[11] Patent Number: 5,203,507

[45] Date of Patent: Apr. 20, 1993

[54] AIR POWERED SPRAYER FOR DISPENSING MATERIAL SLURRIES

[76] Inventor: Richard H. Matthews, 254 Arlington Cir., Woodland, Calif. 95695

[21] Appl. No.: 625,466

[22] Filed: Dec. 11, 1990

[51] Int. Cl.[5] ..... B05B 7/06

[52] U.S. Cl. ..... 239/373; 239/322; 239/424; 222/389; 141/27

[58] Field of Search ..... 141/25, 27, 29; 239/373, 322, 321, 147, 424, 8, 9; 222/334, 389

[56] References Cited

U.S. PATENT DOCUMENTS

| | | | |
|---|---|---|---|
| 1,704,623 | 3/1929 | McManamra . | |
| 2,819,928 | 1/1958 | Liedberg | 222/334 |
| 3,163,362 | 12/1964 | McFee | 239/401 |
| 3,515,354 | 6/1970 | Presson | 239/416.5 |
| 3,733,032 | 5/1973 | McLeod | 239/373 |
| 3,780,910 | 12/1973 | Wagner | 222/95 |
| 4,174,068 | 11/1979 | Rudolph | 239/322 |
| 4,215,802 | 8/1980 | Ornsteen | 222/146 |
| 4,516,700 | 5/1985 | Guzowski | 222/334 |
| 4,519,545 | 5/1985 | Kuminecz | 239/288 |
| 4,635,830 | 1/1987 | Wehr et al. | 222/334 |
| 4,824,022 | 4/1989 | Hillemeier | 239/9 |
| 4,859,121 | 8/1989 | Deysson et al. | 406/114 |

FOREIGN PATENT DOCUMENTS

| | | | |
|---|---|---|---|
| 237821 | 2/1962 | Australia | 239/147 |
| 149826 | 6/1937 | Austria | 239/322 |
| 1047686 | 12/1958 | Fed. Rep. of Germany | 239/147 |
| 505093 | 12/1954 | Italy | 239/322 |
| 217300 | 6/1924 | United Kingdom | 239/373 |
| 472432 | 9/1937 | United Kingdom | 239/322 |

*Primary Examiner*—Gregory L. Huson
*Assistant Examiner*—Christopher G. Trainor
*Attorney, Agent, or Firm*—Bernhard Kreten

[57] ABSTRACT

An air powered sprayer for dispensing material slurries such as stucco or texturing on substrate such as drywall. The sprayer includes a canister assembly within which a piston assembly is adapted to reside and reciprocate along the length of the canister. An air inlet is disposed at one end of the piston canister assembly, and at an opposite end, a slurry inlet and outlet device is provided. Upstream from the slurry outlet there is a nozzle assembly which allows the through passage of the slurry material for subsequent combination with air at a nozzle assembly for broadcasting on the surface to be treated.

9 Claims, 4 Drawing Sheets $CO_2$ POWER

AIR POWERED SPRAYER FOR DISPENSING MATERIAL SLURRIES

FIELD OF THE INVENTION

The following invention relates to a spray device which dispenses material slurries under air pressure on surfaces to texture or stucco the surface.

BACKGROUND OF THE INVENTION

Frequently, when one installs sheetrock in new installations, a textured surface is the preferred treatment for finishing the sheetrock immediately prior to painting. One reason for textured surfaces involves the surface characteristics which attend the use of sheetrock. Typically, adjacent panels of sheetrock must be taped, skimmed and then sanded for a smooth contour. When a wall does not receive a textured treatment, surface imperfections are readily noticeable. By providing a textured surface on the wall, the pattern of texture not only provides an interesting variegated contour, but hides surface blemishes that would otherwise be noticeable upon the finished and painted sheetrock.

On new installations, the application of texture on a sheetrock surface is at best an imprecise art. Typically, an open hopper, loaded with cementitious material in a slurry form, power feeds the cementitious material down to a spray nozzle using an impeller pump all of which is held by the operator. The broadcast pattern is extremely wide on new texturing installations and particulate matter provides a fine mist in the air which will contact all surfaces in the room being treated by the textured material. Of course, during new construction, this is not objectionable so long as the texturing process occurs at the appropriate time during construction i.e. prior to any finish work such as carpet laying, fixtures installation, glass installation has occurred. Otherwise, the textured material is sure to contact all surfaces within the environment.

A separate problem exists when texturing is required to be performed for touchup. This typically occurs when parts of the sheetrock panel need to be modified typically after all other finish work has been done. The known technique of using a wide broadcast pattern is therefore not ideal in this environment, and a noticeable blemish will have been evidenced by even an untrained eye when attempting to provide a textured patch on a given surface. Gravity fed systems magnify these problems for touch-up work.

To date, the prior art is woefully silent in mechanisms which address the problem associated with texture touchups. The following patents reflect the state of the art of which applicant is aware and is intended to discharge applicant's acknowledged duty to disclose known prior art. However, it is stipulated that none of these citations when considered singly nor when combined in any permissible manner teach or render obvious the nexus of applicant's invention particularly as set forth hereinbelow and claimed.

| INVENTOR | U.S. Pat. No. | ISSUE DATE |
|---|---|---|
| McManamna, G. P. | 1,704,623 | March 5, 1929 |
| Wagner, W. | 3,780,910 | December 25, 1973 |
| Rudolph, R. L. | 4,174,068 | November 13, 1979 |
| Ornsteen, R. L. | 4,215,802 | August 5, 1980 |
| Kuminecz et al | 5,519,545 | May 28, 1985 |

-continued

| INVENTOR | U.S. Pat. No. | ISSUE DATE |
|---|---|---|
| Deysson et al | 4,859,121 | August 22, 1989 |

The patent to McManamna teaches the use of an air-driven piston discharging a liquid into a form of air-driven nozzle. It uses two separate systems of air with numerous valves.

The device is similar to the instant invention in that an air-driven piston injects liquid into a nozzle where a separate compressed air source creates a spray. However, many differences are also apparent. No valve exists regulating liquid flow. Also the method and structure by which the instant invention is refilled is substantially different from McManamna.

The patent to Deysson et al. teaches the use of an apparatus for spraying ultrafine powders using two compressed air sources. One drives a piston within the particle-filled chamber and the other enters the chamber to suspend and eject the powder as a particle spray.

The broad concept of Deysson is similar to the invention, in that a dual air flow performs a piston driving function and a spray ejecting function. The structure of this patent is quite different however. The spraying means is substantially dissimilar because no air flow or particle flow regulating valves are included, and no refill apparatus is defined.

The Rudolph patent teaches the use of a disposable cartridge driven by air pressure in the nozzle only, providing a liquid spray. It shares only coincidental similarity with a few components of the instant invention.

The remaining references show the state of the art further. The instant invention appears to be the only device with a valve regulating fluid flow, and the concommitant method and structure for refilling the chamber appears patentably distinguishable over the prior art.

SUMMARY OF THE INVENTION

The instant invention is distinguished over the known prior art in a plurality of ways. In essence, the invention includes an air-powered sprayer for dispensing material slurries which includes a canister assembly within which a piston assembly is disposed. At one end of the canister there is provided an inlet which divides air into two branches. One branch powers the piston and advances the piston along the longitudinal axis of the canister, and another branch delivers air to output nozzle assembly.

The piston and canister assembly in essence includes a piston adapted to reciprocate within the canister. At one extreme stroke, where the piston is adjacent the air inlet a full charge of the cementitious slurry is provided upstream from the air inlet. As the piston advances along the longitudinal axis of the canister under air pressure, the cementitious material is dispensed out an opposite end of the canister where it communicates with a slurry inlet and outlet.

The slurry inlet and outlet in essence includes a branch passageway which allows the cementitious material to be reinserted into the canister for successive charges to replenish the material within the canister. Appropriate manipulation by closing a valve upstream from the slurry inlet, allows this slurry inlet to fill the canister. Cementitious material can advance beyond the valve when the valve is open and the slurry inlet is closed and thence onward to a nozzle assembly.

As mentioned earlier, the air which drives the piston within the canister assembly has a second branch apart from the one which drives the piston. This second air branch communicates with the nozzle assembly and provides a second means for propelling the cementitious material out in the desired pattern to replicate the textured surface on the wall that is being patched. In essence, the nozzle assembly allows fluid communication between the cementitious material and the air, and this contact is influenced by a nozzle assembly that causes the confluence of the air and cementitious material to occur in any of a multiplicity of ways by advancement of a nozzle tip along a nozzle housing or an air tube along the nozzle housing to change the broadcast pattern of the aerated cementitious material.

Another form of the invention contemplates providing a reservoir integrally carried on a support platform to facilitate the recharging process of cementitious material within the canister assembly.

The geometry of the mechanism according to the present invention lends itself to not only spraying textured material on a wall, but also other materials, such as stucco.

OBJECTS OF THE INVENTION

Accordingly, it is a primary object of the present invention to provide a novel and useful air-powered sprayer for dispensing material slurries.

A further object of the present invention is to provide a device as characterized above which is particularly adapted to facilitate the through passage of material commonly used in texturing walls particularly when applying the textured material on a small patch so as to control the broadcast pattern substantially exclusively on the patch and not contaminate finish work adjacent the patched area.

A further object of the present invention is to provide a device as characterized above which benefits from the geometry of the apparatus so that it is adaptable for utilization with other types of cementitious material apart from sheetrock texturing, such as stucco or even insulating material.

A further object of the present invention is to provide a device as characterized above which is extremely easy to manufacture since many parts are standardized and can be taken from other environments, lends itself to mass production techniques and is extremely durable in construction and safe to use.

A further object of the present invention is to provide a device as characterized above which divides incoming air that pressurizes the slurry into two branches, a first branch which allows the cementitious material forming the slurry to be pushed downstream to a dispensing nozzle and a second branch which communicates with the nozzle assembly for direct beneficial atomization and aeration of the slurry mixture when being broadcast.

A further object of the present invention is to provide a device as characterized above which, when the two air inlet branch passages have been appropriately balanced, provides total control of the broadcast pattern by manipulation of a single valve adjacent the nozzle.

A further object of the present invention is to provide a device as characterized above which allows modification of the broadcast pattern in a multiplicity of ways to emulate the desired effect when matching preexisting textured surfaces on a supporting substrate such as sheetrock.

Viewed from a first vantage point, it is an object of the present invention to provide a sprayer for dispensing slurries which includes a nozzle, a source of air, a canister operatively interposed between the nozzle and the air source whereby the air source indirectly acts on the nozzle through the canister, and a device for admitting the slurry into the canister to charge the canister. A valve means is interposed between the canister and the nozzle to regulate the through passage of the slurry therebeyond and a direct source of air acts on the nozzle so that the source of air effects the slurry both by pushing it towards the nozzle and at the nozzle itself.

Viewed from a second vantage point, it is an object of the present invention to provide a texture spray dispenser for applying an aerated slurry to a support surface which includes a nozzle for receiving both air and non-aerated slurry, a canister in communication with the nozzle containing the non-aerated slurry therewithin, a valve interposed between the canister and the nozzle and a means to urge the non-aerated slurry from the canister to the nozzle.

Viewed from a third vantage point, it is an object of the present invention to provide a method for dispensing texture on a surface the steps including, providing a nozzle with both an air inlet and a texture material inlet, forming the texture material initially as a substantially non-aerated slurry, storing the material in a canister having a piston therein with the material on one side of the piston, communicating the canister with the nozzle such that the material flows to the nozzle, and interposing a valve between the canister and the nozzle and regulating the material at the valve prior to admission to the nozzle.

These and other objects will be made manifest when considering the following detailed specification when taken in conjunction with the appended drawing figures.

BRIEF DESCRIPTION OF THE DRAWING FIGURES

BRIEF DESCRIPTION OF THE PREFERRED EMBODIMENTS

Figure 1:
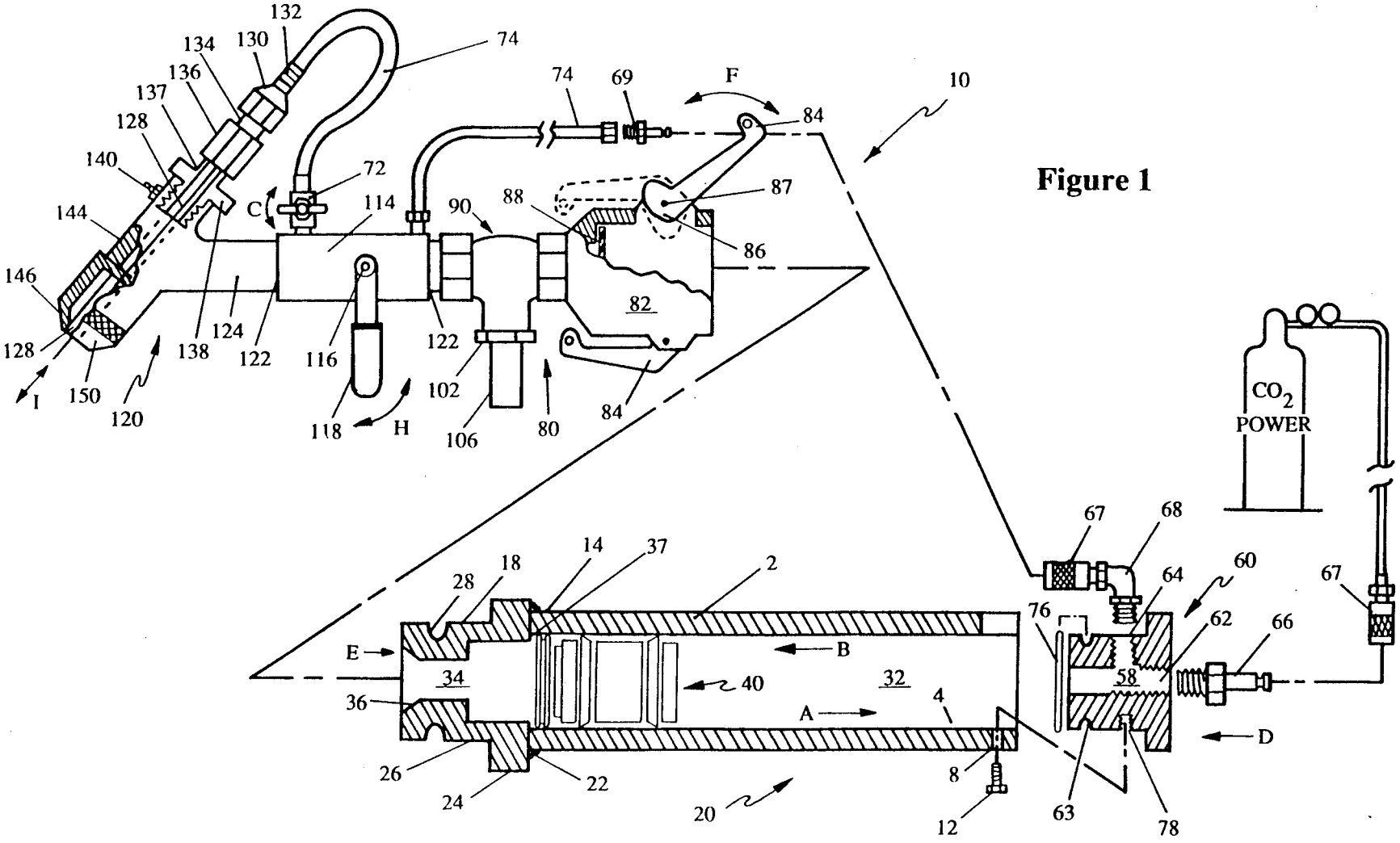
FIG. 1 is a schematic depiction of the apparatus of the present invention according to one form.

Referring to the drawings now, wherein like referece numerals refer to like parts throughout the various drawing figures, reference numeral 10 is directed to the air-powered sprayer for dispensing material slurries.

In essence, and with reference to FIG. 1 especially, the sprayer 10 includes a canister assembly 20 within which a piston assembly 40 is adapted to reciprocate. Reciprocation of the piston assembly 40 along the direction of the arrow A with appropriate manipulation of a slurry inlet and outlet 80, to be described, allows a charge of a cementitious material to be loaded into the canister assembly 20. Motion of the piston assembly 40 along the direction of the arrow B allows the cementitious material to be dispensed through nozzle assembly 120 upon appropriate manipulation of a valve mechanism whose housing is generally depicted at 114. An air inlet 60 located at an extremity of the canister 20 remote from the slurry inlet and outlet 80 powers the piston assembly 40 in the direction of the arrow B and a branch 64 of the air inlet 60 communicates with the nozzle assembly 120 for a final atomization of the slurry at the point of broadcast.

More particularly, and with particular reference to FIGS. 1 through 3 and 5 through 8, the air-powered sprayer 10 for dispensing material slurries includes a canister assembly 20 formed as a elongate cylinder 2 having an air inlet end 4 and slurry receiving end 14. The cylinder 2 defines a hollow 32 within the cylinder which receives the slurry therewithin when the piston assembly 40 is to the extreme right of that which is shown in FIG. 1. Although the text describes "air" passageways, a compressed gas source having carbon dioxide ($CO_2$) may also be used.

The air inlet end 4 receives the air inlet 60. In essence, the air inlet 60 is a unitary mass having an internally formed T-shaped passageway 58 with a main branch 62 and a lateral branch 64 defining the T. A nipple 66 provides a parasitic pressure to reside within the hollow 32, with the balance of the air being directed to an air hose 74. An air valve 72 receives the air from branch 64 via elbow 68 and adjusts the air flow by rotation of the air valve 72 about arrow "C". Once initially calibrated and set, this air valve 72 infrequently needs any adjustment. A quick connect coupling 67, 69 unites the hose 74 to the elbow 68.

The air inlet 60 is fixed to the end 4 of the cylinder 2 by axial insertion of the unitary mass into the end 4 along the direction of the arrow D. A seal 76 circumscribes an annular groove 63 formed on the unitary mass defining the air inlet 60, and the seal 76 abuts against an interior wall of the cylinder 2 near the end 4. The air inlet 60 thus includes a portion which extends out of the canister's air inlet end 4 allowing clearance for the lateral branch 64 to communicate with the elbow 68. The unitary mass defining the air inlet 60 is fixed within the end 4 by means of at least one threaded bore 78 formed in the unitary mass of the air inlet 60 which cooperates with a corresponding screw hole 8 formed in the cylinder 2 adjacent the end 4 and is held there by means of at least one retention screw 12. Preferably five screws 12, holes 8 and bores 78 are provided.

The slurry receiving end 14 of the cylinder 2 is welded at 22 to receive a coupling 18 which in turn allows connection to the slurry inlet and outlet, generally depicted as 80. In essence, the coupling 18 includes an annular weld 22 on the slurry receiving end 14 of the cylinder 2 which supports an annular ring 24 circumscribing the area of interconnection of the coupling 18 with the slurry receiving end 14. Upstream from the ring 24 there is formed a necked-down body portion 26 provided with a peripheral recess 28 circumscribing the outer surface of the coupling 18 as shown in FIG. 1. The recess 28 cooperates with structure on the slurry inlet and outlet 80 to be described. An end wall of the coupling 18 remote from its welded connection to the cylinder 2 has an outer surface dimensioned to seat against a flat annular ring 88 in a manner evident when considering the slurry inlet and outlet 80. The coupling 18 includes an interior 34 in communication with the hollow 32 of the cylinder 2 so that cementitious material can pass therebeyond. The end of the coupling 18 adjacent the annular ring 88 has an outwardly diverging flare 36. The other end of the interior 34 includes a shoulder 37 which provides an abutment stop for the piston assembly 40.

Figure 2:
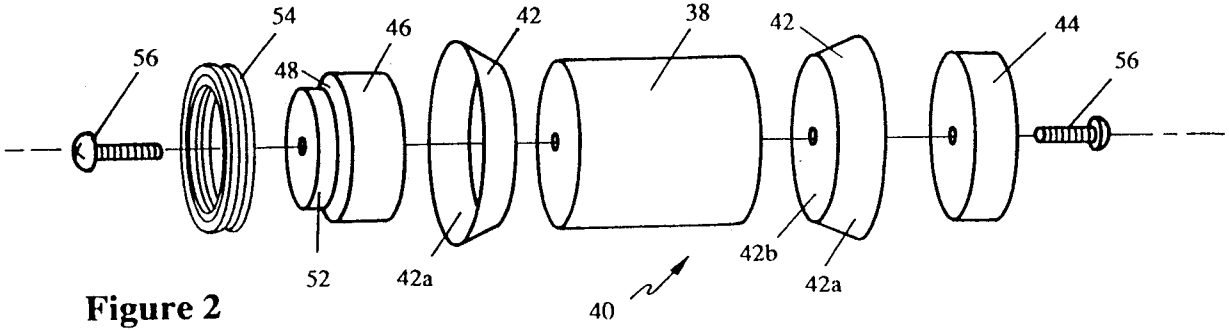
FIG. 2 is an exploded parts view of the piston assembly shown in FIG. 1.

More particularly, details of the piston assembly 40 are shown in FIG. 2. In essence, the piston assembly 40 includes a solid cylindrical piston 38 having an exterior periphery substantially complemental to the interior cross-sectional bore of the hollow 32 of the cylinder 2.

The piston 38 has flat extremities which support thereon a pair of cups 42. Each cup 42 has a base **42*b* adapted to be placed in tangential registery with the piston 38 and an outwardly diverging lip 42*a* circumscribing the outer periphery of the base 42*b* and oriented such that the lips 42*a* flare away from piston 38. The right side of the piston assembly 40 of FIG. 2 reflects a support disc 44 which is received within the right side of cup 42 and allows the cup 42 to retain its cup-shaped contour and provide a reliable seal, since the cups 42 are formed from a resilient material serving as a gasket. The support disc 44 is fixed to the piston 38 by means of a retention screw 56**.

Similarly, the opposite, left-hand side of the piston 38 includes a support plug 46 which retains the shape of the cup 42 on that side. Notice that the support plug 46 includes a shelf 48 which terminates in a necked-down cylindrical puck 52 directed outwardly, away from the piston 38. The outer periphery of the puck 52 in conjunction with the shelf 48 collectively support a gasket 54 of substantially annular configuration thereon. The support plug 46 and puck 52 are fixed onto the piston 38 by means of a second retention screw 56.

Referring again to FIG. 1, it should now be evident that the shoulder 37 formed on an interior of the coupling 18 serves as an abutment stop for the gasket 54 so that the through passage of air around the gasket 54 is not very likely.

Referring to FIGS. 1, 3, 3A and 4, the details with respect to the slurry inlet and outlet 80 can now be explored. In essence, a shroud 82 has an inner contour complemental to the exterior geometry of the coupling 18. Thus as shown by the arrow E, the shroud 82 is adapted to telescope over the coupling 18. The shroud 82 is fixed to the coupling 18 by means of a pair of cams 86 located on diametrically opposed sides of the shroud 82 and operated by handles 84 pivoted thereto. A pivot 87 allows the cam 86 to coact with the peripheral recess 28 formed on an outer annular surface of the coupling 18. When the cam handle 84 is moved from the solid position at the top of FIG. 1 along the arrow F to the locked position at the bottom of FIG. 1, the cams are urged within the recess and therefore reliably affix the shroud 82 onto the coupling 18. The annular ring gasket 88 is therefore pressed against a flat seat 89 (FIG. 4) providing a reliable seal. The handle 84 is attached to the cam 86 by means of the pivot 87 so that the lobe of each cam 86 enters and locks into the recess 28.

Figure 3A:
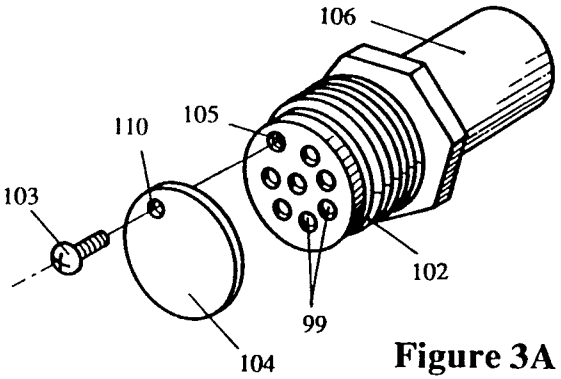
FIG. 3A is a perspective view of one aspect of FIG. 3.
Figure 3:
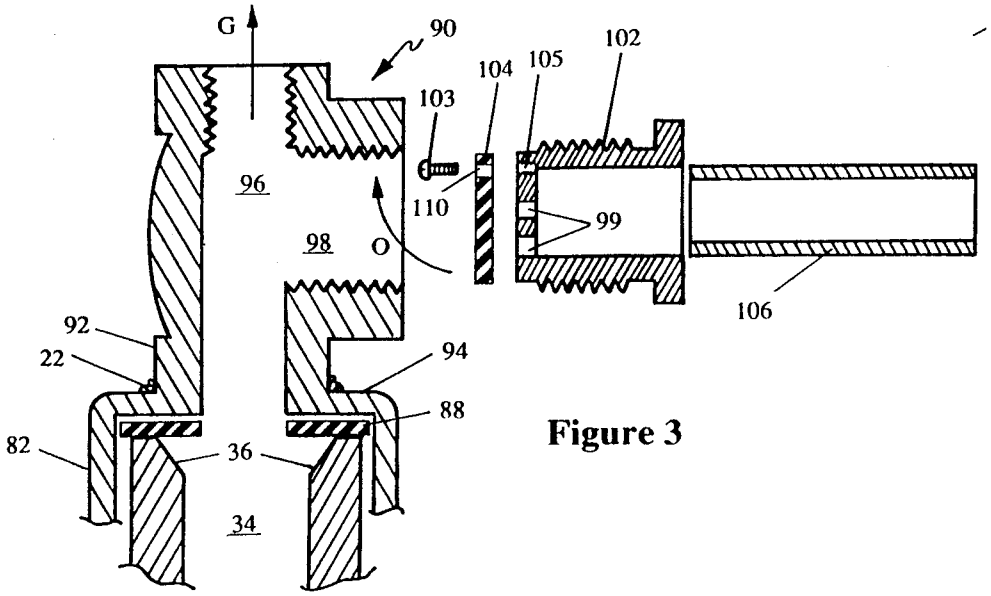
FIG. 3 is a sectional view of another aspect of FIG. 1 providing further detail of the slurry inlet and outlet structure.

The shroud 82 fixes to a refill T 90 as best shown in FIG. 3. In essence, the shroud 82 includes a stub 92 which adheres to the refill T 90 by means of a collar 94 welded 22 to the stub 92. The stub 92 communicates with a main body of the refill T 90 by having an interior bore defining a main outlet passageway 96 and an inlet passageway 98. Thus, a substantially T-shaped hollow is formed. Downstream from the outlet passageway 96 (in the direction of the arrow G) a valve to be described can be opened or closed. When the valve is closed, the canister 20 can be refilled. In essence, the inlet passageway 98 communicates with an externally threaded ferrule 102 that fastens with an interior thread on the inlet passageway 98. The ferrule 102 includes a flap valve 104 fastened with a screw 103 in a threaded bore 105 formed in the ferrule and hole 110 in the flap 104. The ferrule 102 also communicates with a nipple 106 within which the slurry can be admitted. The nipple 106 may be selectively occluded by a cap (not shown). The ferrule 102 nearest the flap 104 has apertures 99 to admit cementitious material.

After the contents within the hollow 32 of the cylinder 2 has been exhausted and the piston assembly 40 is shown in the FIG. 1 position, the upstream valve is closed to refill the cylinder 2. The upstream valve is shown in FIGS. 1 and 5–7.

The valve itself includes a cylindrical valve 112 adapted to rotate along the direction of the double-ended arrow H in response to complemental rotation of a handle 118. The valve handle 118 is connected to the valve 112 by means of a pivot 116. The pivot 116 is supported in a housing 114 within which a cylindrical, hollow valve channel 115 is defined. Fittings 122 on opposite sides of the valve assembly connect, at one end, to the refill T 90 and the nozzle assembly 120 at another end as shown. When the valve is closed as shown in FIG. 1, the interior hollow 32 of the cylinder 2 can be refilled.

In essence, and referring again to FIGS. 3 and 3A, the nipple 106 is coupled to a source of cementitious material. An alternative, shown in FIG. 4, for example, depicts the source as a reservoir R and a wand 160 which powers the cementitious material from the reservoir R through a pump 162. Pumping the slurry of cementitious material into the nipple 106 of FIG. 3 will direct the slurry through the inlet passage 98, beyond the interior 34 and cause the piston assembly 40 to move in the direction of the arrow A. This allows the cementitious material to fill the hollow interior 32 of the cylinder 2. While the cylinder is being filled with cementitious material, the flap 104 moves along the arrow "O". When filled the flap is reinserted on the nipple 106.

The tendency of the slurry will be to allow air to advance back up the interior 34 and to the inlet passageway 98. The parasitic air pressure moving up passageway main branch 62 causes the piston assembly 40 to move in the direction of the arrow B and the device can be bled of air by appropriate manipulation of the cylindrical valve 112 via handle 118. When all air has been evacuated from the hollow 32, interior 34 and passageway 96, 98, the device is ready for utilization. The handle 118 is rotated along the direction of the arrow H to crack the valve 112 to allow the slurry to advance beyond the fitting 122 to the left of the valve. The cementitious material thereafter enters into the nozzle housing assembly 120.

Rotation of handle 118 also controls the air flow substantially simultaneously. Actually, when the valve is just opened the air leads the slurry in through passageway 96 beyond the valve 112 and to the nozzle 120. In essence, and as per FIGS. 5–7, the valve 112 is formed as a cylinder having a slurry passageway 172 and a slurry stop 180. Also an air passageway 174 and air stop 178 is provided on the cylinder 112 so that the handle 118 operates both. O rings 176 fitted in grooves of the cylinder isolate the air passageway by straddling the air passageway. Thus, air passageways 75 on opposite sides of the valve 112 can be controlled as well as passage of the slurry from 96 through to the nozzle 120.

The nozzle assembly 120 shown in FIG. 1 includes a slurry branch 124 which connects to the valve body 114 through weld 122. The hose 74 having air therein also communicates with the nozzle 120 by means of a coupling to the nozzle 120 that allows axial translation of the air along the direction of the arrow I. More specifically, the air hose 74 couples to the nozzle 120 by means of an adjustable nut 136 having threads 137 that coact with a bushing 138 so that the nut 136 can advance along the longitudinal axis (I). The nut 136 supports an internal air tube 128 and allows it to move axially. In order to facilitate rotation of the coupling nut 136 with respect to the packing gland 138, a zirk fitting 140 isolates the area of rotation within the nozzle 120 and provides lubrication so that the nut 136 can be advanced thereby advancing the air tube 128 along the direction of the arrow I. The air hose 74 couples to the nut 136 by means of a fastener 130 having a circumscribing boot 132 at an end of the fastener 130 remote from the nut 136 Lubrication of the area of contact between the bushing 138 and the threads 137 on the nut 136 allow hand adjustment of nut 136 and thus air tube 128 without the necessity of tools.

The threaded air tube 128 alters the relationship of exiting air with respect to the slurry at the tip 146 of the nozzle 120. More specifically, the nozzle tip 146 carries a inwardly tapered conical wall which varies the spacing between the air tube 128 as it addresses the nozzle tip 146. Varying the relationship of the air tube 128 at this point alters the broadcast pattern of the slurry as it exits the 120 nozzle. Thus, two forms of adjustment are possible at this point. Axial adjustment of the air tube 128 relative to the tip 146 of the nozzle 120 along with the air valve 72 affects the spray from the device 10. It is contemplated that the primary adjustment occurs using the axial translation of the air tube 128. Various nozzle tips 146 can be substituted so that different broadcast patterns with respect to its coaction with the air tube 128 will be possible. In essence, slurry coming from the branch 124 will pass into the nozzle through slurry chamber 144 and thereafter pass beyond the nozzle tip 146 around the air tube 128. The placement of the air outlet 128 with respect to the nozzle 120 and the slurry will define the broadcast pattern.

Figure 4:
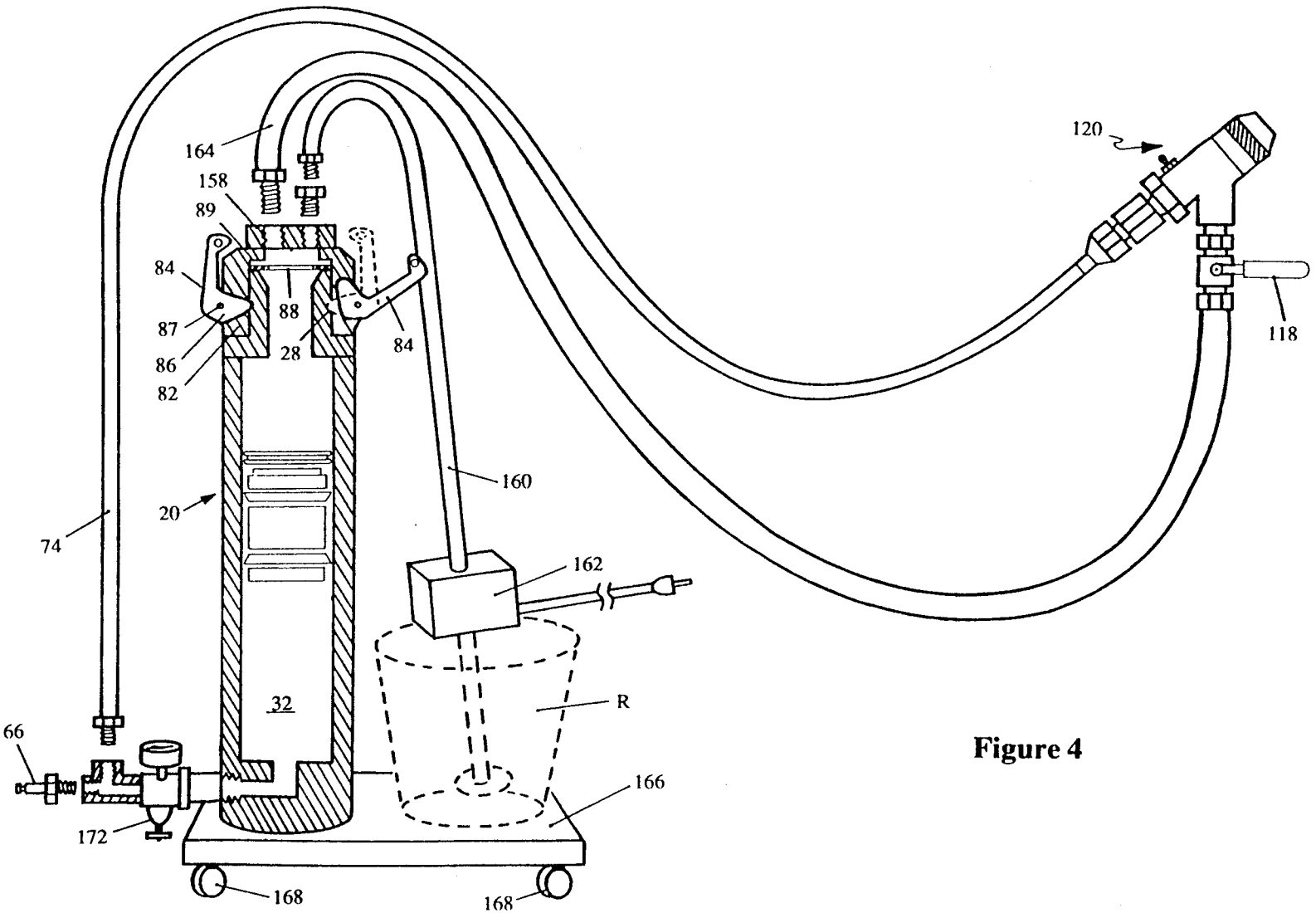
FIG. 4 is a schematic depiction of a second modified form of the invention when larger areas are to be treated with a textured surface.
Figure 7:
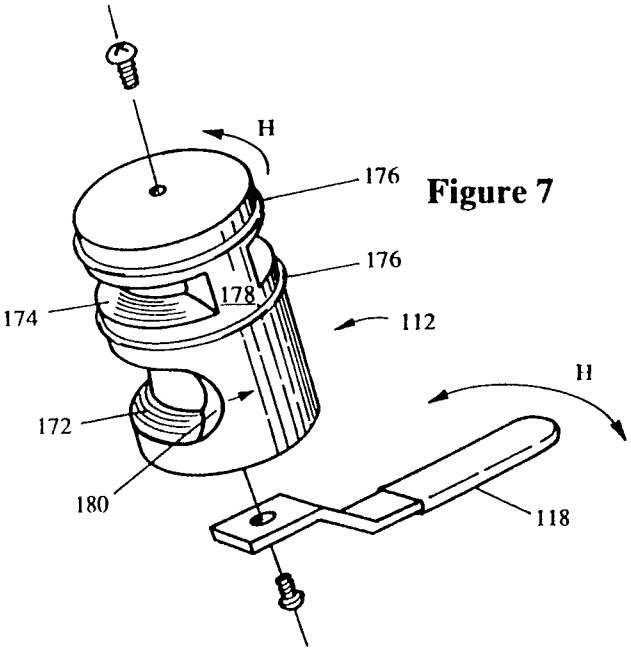
FIG. 7 is a perspective view of the valve cylinder depicted in FIGS. 5 and 6.
Figure 8:
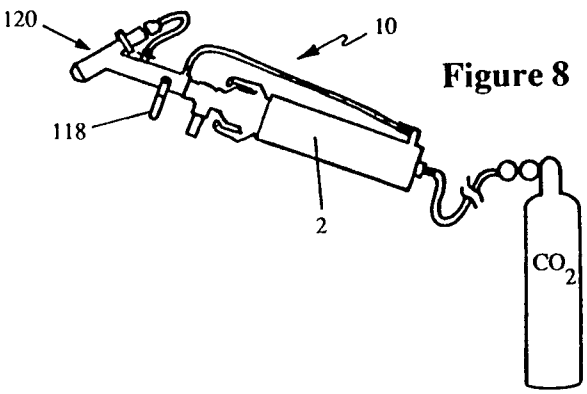
FIG. 8 shows FIG. 1 assembled, in compact form, and ready for use.
Figure 5:
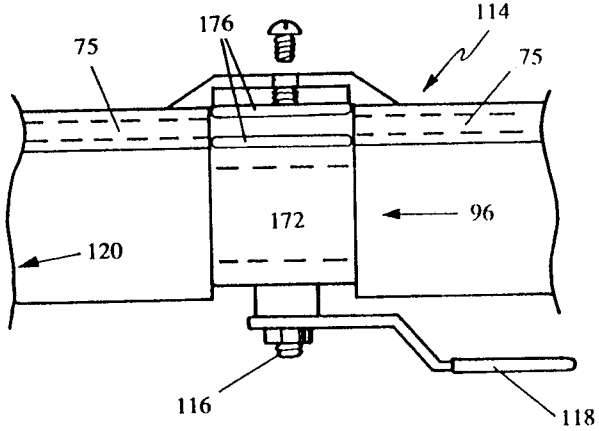
FIG. 5 is a top view of the valve structure of FIG. 1 with dotted lines showing interior flow passageways.
Figure 6:
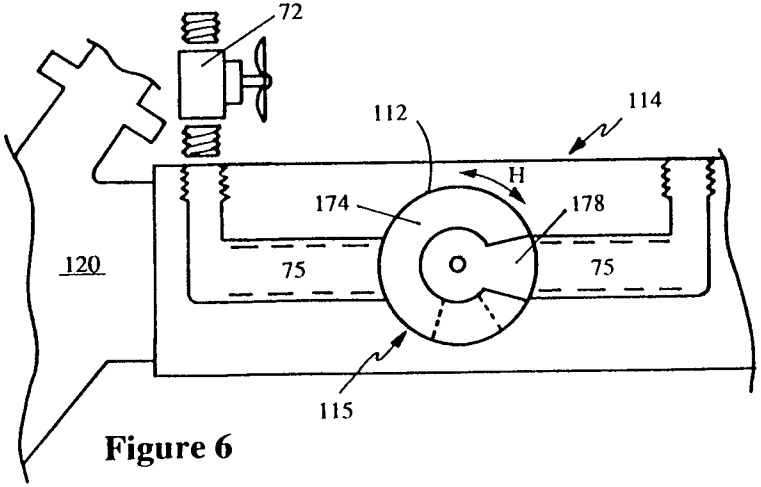
FIG. 6 is similar to FIG. 5, but from a side opposite from FIG. 1.

With reference to FIG. 4, a modification briefly alluded to earlier should now be evident. Like reference numerals refer to like parts and will not be belabored. In this version, the refill T 90 of FIG. 1 has been replaced with a plate 158 having two threaded opening: one for the refill wand 160 (which was described in FIG. 3 with regard to the nipple 106) and one for a slurry outlet hose 164. This plate 158 couples to the shroud 82 in a manner similar to the FIG. 1 version.

Thus, one primary difference involves the utilization of the slurry outlet hose 164 which allows the nozzle 120 to be carried further from the canister 20 than in the FIG. 1 version. The canister 20 is preferably supported on a support base 166 having wheels 168 that allow the device to be more easily transported in the work environment. A reservoir R carries the cementitious material which is delivered to the interior 32 of the canister 20 by means of a positive displacement pump 162 connected to a power source (not shown). Thus, the pump 162 serves as an abutment beyond which the cementitious material will not pass so that it will not circulate back into the reservoir R when air pressure is applied at the bottom of the canister 20.

In addition, the pressure regulator 172 in FIG. 4 is interposed between the main branch of the canister and the nipple 66 rather than on the air hose 74. Thus, air is metered into the hollow 32 and the surplus is directed through the hose 74. It is contemplated that either valve 72 or 172 could be located adjacent the nozzle 120 for air pressure regulation at that point if desired.

Moreover, having thus described the invention, it should be apparent that numerous structural modifications and adaptations may be resorted to without departing from the scope and fair meaning of the instant application as set forth hereinabove and as described hereinbelow by the claims.

I claim:

1. A sprayer for dispersing slurries, comprising, in combination:

a nozzle, a source of air, a canister operatively interposed between said nozzle and said air source whereby said air source indirectly acts on said slurry through said canister, means for admitting the slurry into said canister to charge said canister, means for isolating the slurry from said source of air within said canister, a valve means interposed between said canister and said nozzle to regulate the through passage of the slurry therebeyond, and direct means at said nozzle whereby said source of air directly affects the slurry at said nozzle, wherein said valve means includes a fully closed position and thereby cooperates with said admitting means for the slurry whereby closure of said valve means allows the slurry to be admitted within said canister, wherein said isolating means includes a piston assembly adapted to reciprocate within said canister having a one end in fluid communication with said source of air and another end in communication with both said slurry admitting means and said valve means whereby closure of said valve means and admission of the slurry within said canister causes said piston assembly to advance towards said air source thereby filling said canister, including means to selectively occlude said slurry admitting means whereby opening of said valve means and application of said air source to said piston advances the slurry beyond said valve means and towards said nozzle, wherein said direct means includes an air tube oriented to extend axially symmetrically within said nozzle and said slurry is adapted to circumscribe said air tube, whereupon broadcasting of the slurry can be modified by adjusting the relationship of said air tube with respect to said nozzle.

2. A sprayer for dispensing slurries, comprising, in combination:

a nozzle.

a source of air, a canister operatively interposed between said nozzle and said air source whereby said air source indirectly acts on said slurry through said canister, means for admitting the slurry into said canister to charge said canister, a valve means interposed between said canister and said nozzle to regulate the through passage of the slurry therebeyond.

and direct means at said nozzle whereby said source of air directly affects the slurry at said nozzle, wherein said valve means includes a fully closed position and thereby cooperates with said admitting means for the slurry whereby closure of said valve means allows the slurry to be admitted within said canister, wherein said canister includes a piston assembly adapted to reciprocate within said canister having a one end in fluid communication with said source of air and another end in communication with both said slurry admitting means and said valve means whereby closure of said valve means and admission of the slurry within said canister causes said piston assembly to advance towards said air source thereby filling said canister, including means to selectively occlude said slurry admitting means whereby opening of said valve means and application of said air source to said piston advances the slurry beyond said valve means and towards said nozzle, wherein said direct means includes an air tube oriented to extend axially symmetrically within said nozzle and said slurry is adapted to circumscribe said air tube, whereupon broadcasting of the slurry can be modified by adjusting the relationship of said air tube with respect to said nozzle.

3. The sprayer of claim 2 wherein said piston assembly includes a piston having a first and second cup shaped members on opposed ends of said piston having a base and a peripherally circumscribing lip diverging outwardly away from said piston to provide a seal on opposed extremities of said piston.

4. The sprayer of claim 3 wherein said cups are provided with additional support by means of a support disc on one side of said piston adjacent said air source and a support plug on an opposite side.

5. The sprayer of claim 4 wherein said source of air is divided into two air paths, one path directed to said canister and another path directed to said nozzle and valve means interposed on one of said two air paths to alter the air flow rate therebeyond.

6. A sprayer for dispensing slurries, comprising, in combination:

a nozzle, a source of air, a canister operatively interposed between said nozzle and said air source whereby said air source indirectly acts on said slurry through said canister, means for admitting the slurry into said canister to charge said canister, a valve means interposed between said canister and said nozzle to regulate the through passage of the slurry therebeyond, and direct means at said nozzle whereby said source of air directly affects the slurry at said nozzle, wherein said direct means includes an air tube oriented to extend axially symmetrically within said mozzle and said slurry is adapted to circumscribe said air tube, whereupon broadcasting of the slurry can be modified by adjusting the relationship of said air tube with respect to said nozzle.

7. A method for dispensing texture material on a surface, the steps including:

providing a nozzle with a nozzle inlet and sublet forming the texture material as a non-aerated slurry, storing the material in a canister having a piston therein, with the material on one side of the piston, communicating the canister with the nozzle such that the material has access to the nozzle, applying a force on the piston on a side of the piston remote from the slurry, and driving the piston and the adjacent material toward the nozzle, interposing a valve between the canister and the nozzle, and regulating the material admitted to the nozzle with the valve, wherein said applying step includes placing air pressure on the piston on a side remote from the material to drive the material toward the nozzle coupling air pressure to an air tube extending within the nozzle, the air tube having an outlet located adjacent the outlet of said nozzle, and balancing the air directed to the piston and the nozzle, further including providing a material inlet between the valve and the piston for admitting the material into the cannister, and filling the canister with the material by shutting off the valve and forcing material into the canister thereby moving the piston towards the air source, further including adjusting the location of the air tube with respect to the outlet of the nozzle and to vary the geometry of a cavity defined by a tip of the nozzle end the air tube to alter the broadcast pattern of the thus aerated material.

8. A method for dispensing texture material on a surface, the steps including:

providing a nozzle having a nozzle inlet and outlet forming the texture material as a non-aerated slurry, storing the material in a canister having a piston therein, with the material on one side of the piston, communicating the canister with the nozzle such that the material flows to the nozzle, interposing a valve between the canister and the nozzle, regulating the material admitted to the nozzle with the valve, placing air pressure on the piston on a side remote from the material and coupling air pressure to an air tube extending within the nozzle, the air tube having an outlet located adjacent the outlet of the nozzle, balancing the air directed to the piston and the nozzle, providing a material inlet between the valve and the piston for admitting the material into the cannister, filling the canister with the material by shutting off the valve and forcing material into the canister thereby moving the piston towards the air source, and adjusting the location of the air tube with respect to the outlet of the nozzle to vary the geometry of a cavity defined by a tip of the nozzle to alter the broadcast pattern of the thus aerated material.

9. A method for dispensing texture material on a surface, the steps including:

providing a nozzle with an air inlet and a texture material inlet and outlet forming the texture material as a non-aerated slurry, storing the material in a canister having a piston therein, with the material on one side of the piston, communicating the canister with the nozzle such that the material flows to the nozzle, interposing a valve between the canister and the nozzle, regulating the material admitted to the nozzle with the valve, and adjusting the location of an air injection tube extending within said nozzle and having an outlet located adjacent the outlet of said nozzle to vary the geometry of a cavity defined by a tip of the nozzle and the air tube to alter the broadcast pattern of the thus aerated material.

* * * * *